US006264068B1

(12) United States Patent
Ours et al.

(10) Patent No.: US 6,264,068 B1
(45) Date of Patent: Jul. 24, 2001

(54) ONE-HANDED CONTAINER FOR DISPENSING A SOLID AND A LIQUID

(75) Inventors: David C. Ours; John P. Hodge, both of Marshall, MI (US)

(73) Assignee: Kellogg Company, Battle Creek, MI (US)

( * ) Notice: Subject to any disclaimer, the term of this patent is extended or adjusted under 35 U.S.C. 154(b) by 0 days.

(21) Appl. No.: 09/217,175

(22) Filed: Dec. 21, 1998

Related U.S. Application Data

(60) Provisional application No. 60/070,526, filed on Jan. 6, 1998.

(51) Int. Cl.[7] ..... B67D 5/56

(52) U.S. Cl. ..... 222/129; 220/90.2

(58) Field of Search ..... 222/129, 192, 222/426, 94, 482, 99, 206, 215, 220; 220/90.2

(56) References Cited

U.S. PATENT DOCUMENTS

| | | | |
|---|---|---|---|
| Re. 35,437 | | 2/1997 | Ascone . |
| 3,288,344 | | 11/1966 | Woollen et al. . |
| 4,043,478 | | 8/1977 | Duncan . |
| 4,277,000 | | 7/1981 | Jaarsma . |
| 4,444,324 | | 4/1984 | Grenell . |
| 4,548,339 | * | 10/1985 | Gorman ..... 222/129 |
| 4,558,804 | | 12/1985 | Keck . |
| 4,669,608 | | 6/1987 | Thompson . |
| 4,691,821 | | 9/1987 | Hofmann . |
| 4,793,517 | * | 12/1988 | Washut ..... 222/129 |
| 5,180,079 | * | 1/1993 | Jeng ..... 222/129 |
| 5,477,978 | | 12/1995 | Lo . |
| 5,496,575 | | 3/1996 | Newarski . |
| 5,514,394 | | 5/1996 | Lenahan . |
| 5,588,561 | | 12/1996 | Ness . |
| 5,706,980 | | 1/1998 | Dickerson . |

* cited by examiner

*Primary Examiner*—Philippe Derakshani
*Assistant Examiner*—Thach H Bui
(74) *Attorney, Agent, or Firm*—Howard & Howard

(57) ABSTRACT

Disclosed is a multi-compartment container for storing and dispensing a solid and a liquid with the use of one hand. The container has a first compartment for holding a particulate solid food, and a second compartment for holding a liquid. The first compartment is positioned generally above the second compartment, and has a lateral opening for dispensing the food when the container is tilted. The second compartment has a straw-like structure which runs up the side of the container on a side away from the opening of the first compartment.

11 Claims, 11 Drawing Sheets

ONE-HANDED CONTAINER FOR DISPENSING A SOLID AND A LIQUID

This application claims benefit to U.S. provisional application No. 60/070,526, filed Jan. 6, 1998.

FIELD OF THE INVENTION

The present invention generally applies to the field of food packaging and dispensing. More specifically, the present invention relates to multi-compartment food packages providing storage and one-handed dispensing of food therein.

SUMMARY OF THE INVENTION

The present invention is a hand held container having at least two compartments. A first compartment stores a particulate solid food, and a second compartment, positioned below or by the first compartment, stores a liquid.

A partition between the two compartments keeps the contents of the two compartments from mixing inside the container. While the container remains unopen, it stores the food therein. Once the container is opened, it dispenses either the food in the first compartment, or the liquid in the second compartment. Dispensing is regulated by the use of one hand.

Means for dispensing the contents of one compartment at a time are provided with the container. The first compartment has a generally laterally oriented means for dispensing particulate solids contained therein by tilting the container in the direction of the opening. The laterally oriented means is usually an opening positioned on an upper side portion of the first compartment. The opening may or may not have a means for sealing the opening.

The second compartment has means to withdraw liquid therefrom in an upright position without discharging liquid when the container is tilted. In several embodiments of the present invention, the means to withdraw the liquid is a straw-like structure. The straw-like structure is usually positioned on a side away from the dispensing means of the first compartment. A cap for the top of the straw-like structure may also be provided.

DETAILED DESCRIPTION OF THE PRESENT INVENTION

Figure 1:
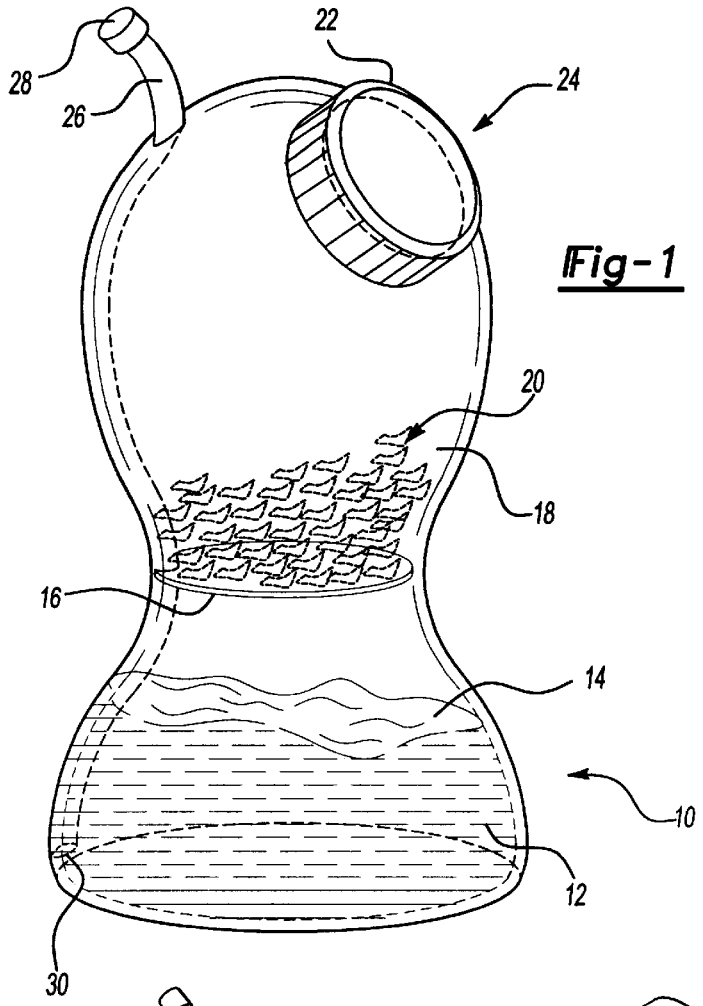

FIG. 1 is a perspective view of a first embodiment of the present invention. The container (10) has a first compartment (18)for storing solid food (20), and a second compartment (12) for storing liquids (14). Separating the two compartments is a partition (16).

The solid food (20) is dispensed from the first compartment (18) through a discharge means or opening (22). The lateral opening (22) is oriented such that the container (10) must be titled in the direction of the opening (22), in order for the solid food (20) therein to pour out of the container (10). The opening (22) has a lid (24).

The liquid (14) stored in the second compartment (12) is withdrawn through a suction means or integrated straw (26). The straw (26) is positioned on a side of the container (10), away from the first compartment's opening (22). The straw (26) has an opening into the second compartment (12) at a point (30), and a cap (28) at the top.

Figure 2:
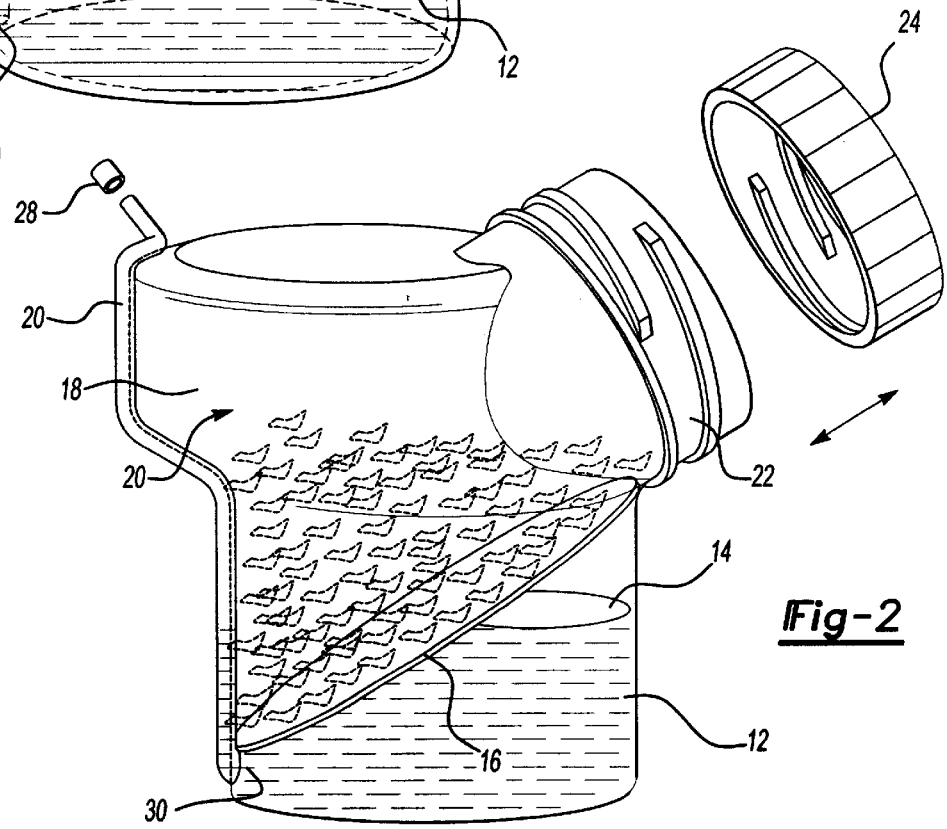

FIG. 2 is a perspective view of a second embodiment of the present invention where the partition (16) between the first compartment (18) and the second compartment (12) is sloped to promote pouring of the solid food (20). The straw (26) follows the contour of the container.

Figure 3:
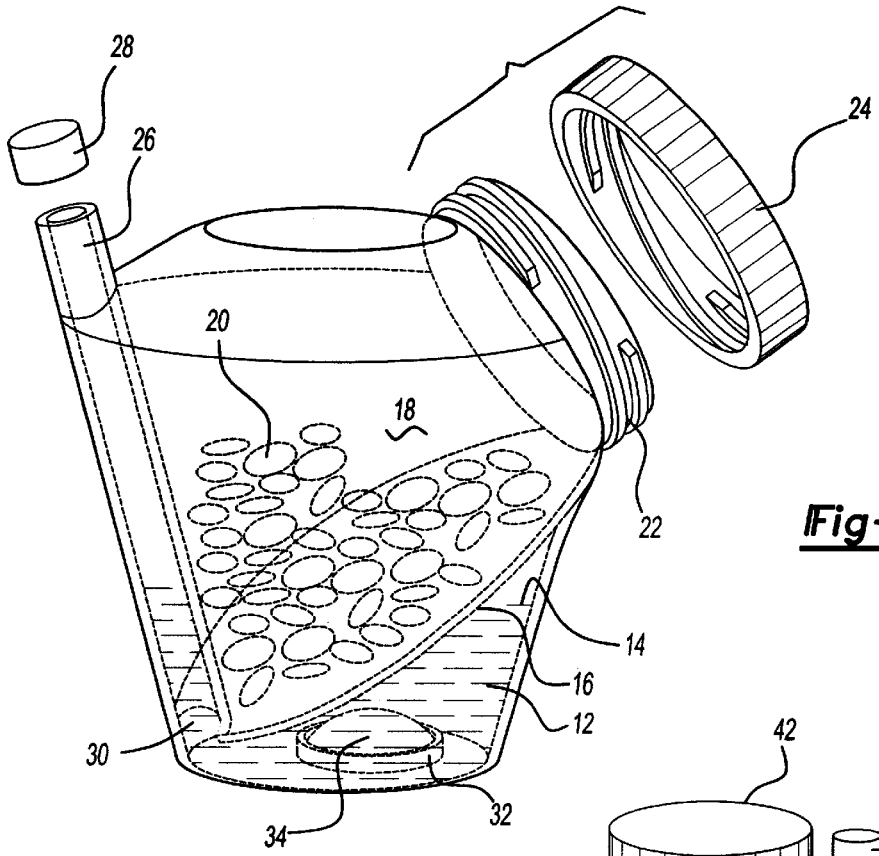

FIG. 3 shows a perspective view of a third embodiment of the present invention. In this embodiment, the second compartment (12) has a fill port (32) with a snap-in flexible diaphragm cap (34) which expands as liquid (14) is withdrawn. The lid (24) for the first compartment's opening (22) screws onto the lip of the opening (22).

Figure 4A:
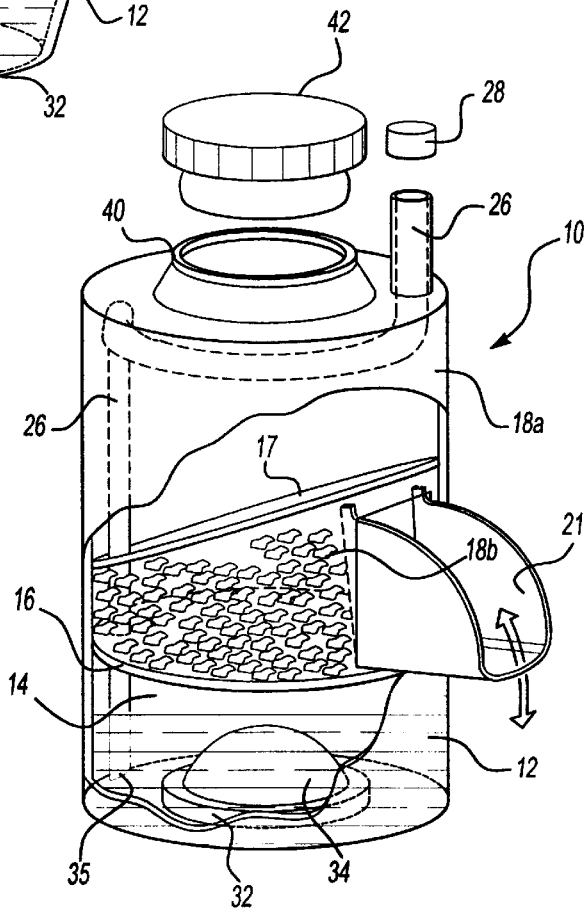
Figure 4B:
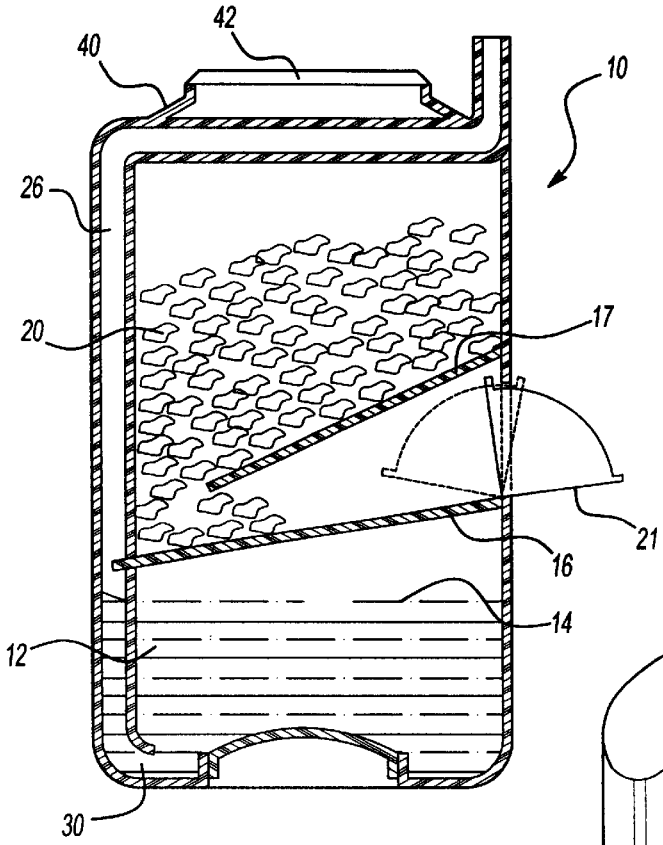

FIGS. 4A and 4B show a fourth embodiment of the present invention. In this embodiment the container allows a user to regulate and limit the amount of solid food (20) dispensed therefrom.

The first compartment (18) is divided in two by a baffle (17). Solid food (20) enters the first compartment (18) through a fill port (40) at the top of the first compartment (18). The baffle (17) confines most of the solid food (20) at the top section of the first compartment **(18*a*), allowing only limited amounts of the solid food (20) to enter the bottom section (18*b*)**.

Solid food (20) is dispensed out of the first compartment (18) through a pull-out spout (21) which is attached to the lower section **(18*b*). When the container (10) is tilted in the direction of the pour spout (21), only the solid food (20) in the bottom section (18*b*) of the first compartment (18) is allowed to flow out of the spout (21). Solid food (20) in the top section (18*a*) is held in place by the baffle (17)**.

The liquid (14) stored in the second compartment (12) is withdrawn through a straw (26) which starts at a point (30), continues up a side of the container (10) until it reaches the top of the container (10), and follows a top edge of the container until it reaches a side of the container where the pour spout (21) is located. A straw cap (28) may be used to close the end of the straw (26) when the straw is not in use.

Figure 5A:
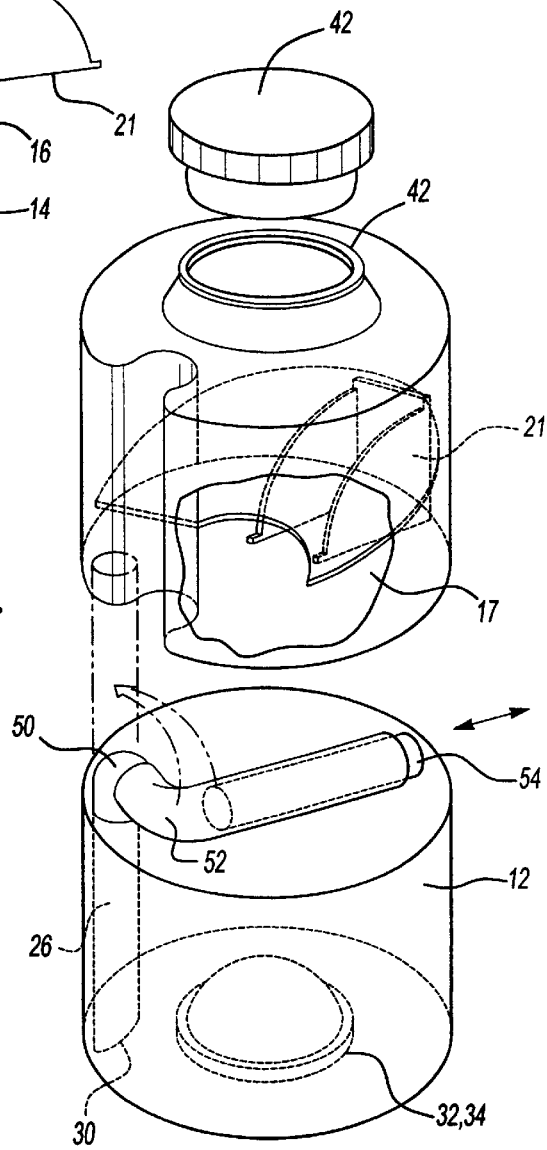
Figure 5B:
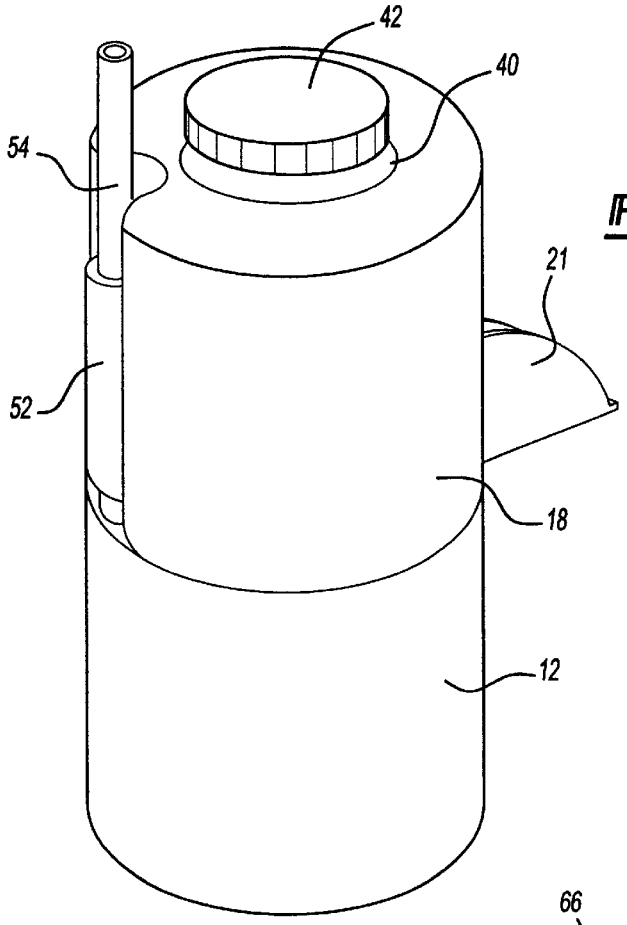

FIGS. 5A and 5B show a fifth embodiment of the present invention where the first compartment (18) is detachable from the second compartment (12). The straw (26) is composed of two sections. The first section of the straw starts at a point (30), follows a side of the second compartment (12) to a point where it forms a joint (50) with a second part of the straw(52). The second part of the straw (52) pivots downward and recesses into a cavity at the top of the second compartment (12) while the straw is not in use. When the straw is being used to withdraw liquid from the second compartment, the second portion of the straw (52) is pivoted upward to follow a side of the first compartment (18). An extension (54) inside the second portion of the straw (52) allows a user to extend the length of the second portion of the straw (52).

Figure 6A:
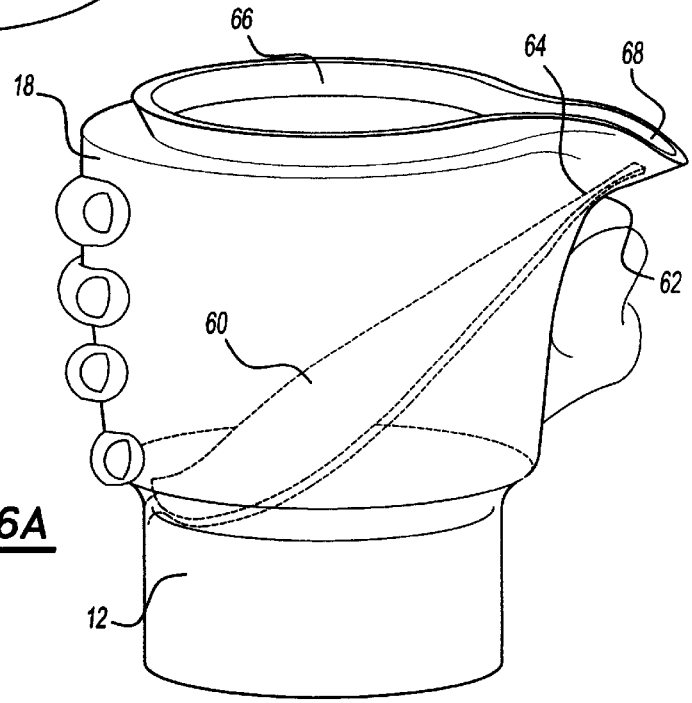
Figure 6B:
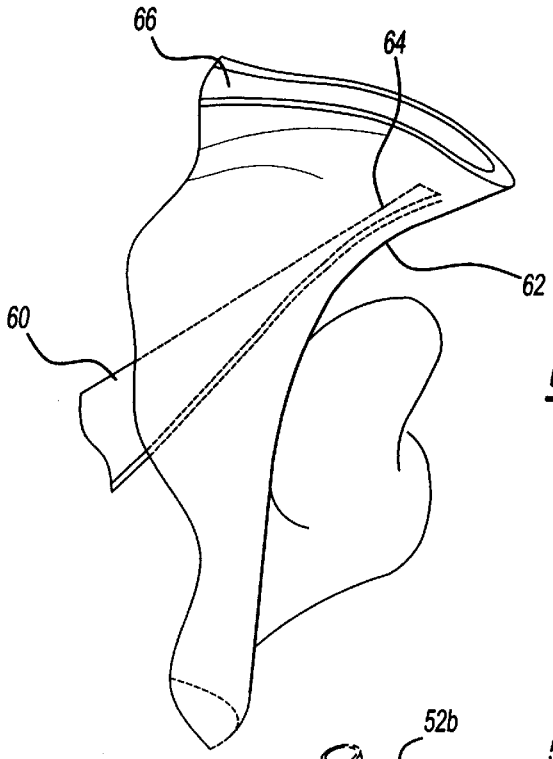

FIGS. 6A and 6B show a sixth embodiment of the present invention. The container (10) has a first compartment (18) and a second compartment (12). The shell of the container is composed of flexible material. The partition (60) is sloped so as to promote pouring of the solid food in the first compartment (18), and to keep the liquid in the second compartment (12) from spilling, when the container (10) is tilted in the direction of a lip (68). The upped end of the partition (64) forms a throat (62) with the inside of the second compartment (12). When a side of the container near the throat (62) is squeezed, the edge of the partition is displaced to allow milk to flow out of the second compartment (12) when the container (10) is tilted towards the lip (68).

The container (10) is provided with a solid food port (66) for putting solid food into the first compartment (18).

Figure 7:
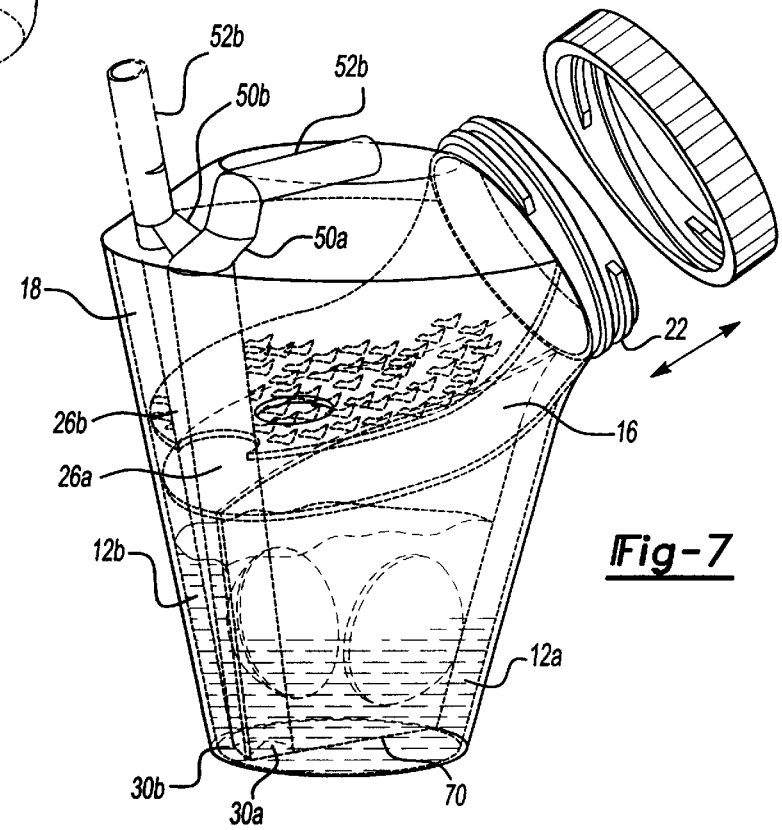

FIG. 7 shows a seventh embodiment of the present invention, where the container (10) has two separate liquid storing compartments for storing liquids. The first liquid compartment **(12*a*) is separated from the second liquid compartment (12***b*) by a vertical partition (70). A solid food compartment (18) is located above the two liquid storing compartments and is separated from the two liquid storing compartments by a partition (16).

Liquid is withdrawn from the first liquid compartment (12*a*) and the second liquid compartment (12*b*) through a first straw (26*a*) and a second straw (26*b*) respectively. Each of the two straws (26*a*, 26*b*) has a second section (52*a*, 52*b*) attached to the straw (26*a*, 26*b*) at a joint (50*a*, 50*b*). Flow of liquid through either of the straws (26*a*, 26*b*) is restricted when a respective second section (52*a*, 52*b*) is in a downward position.

Figure 8A:
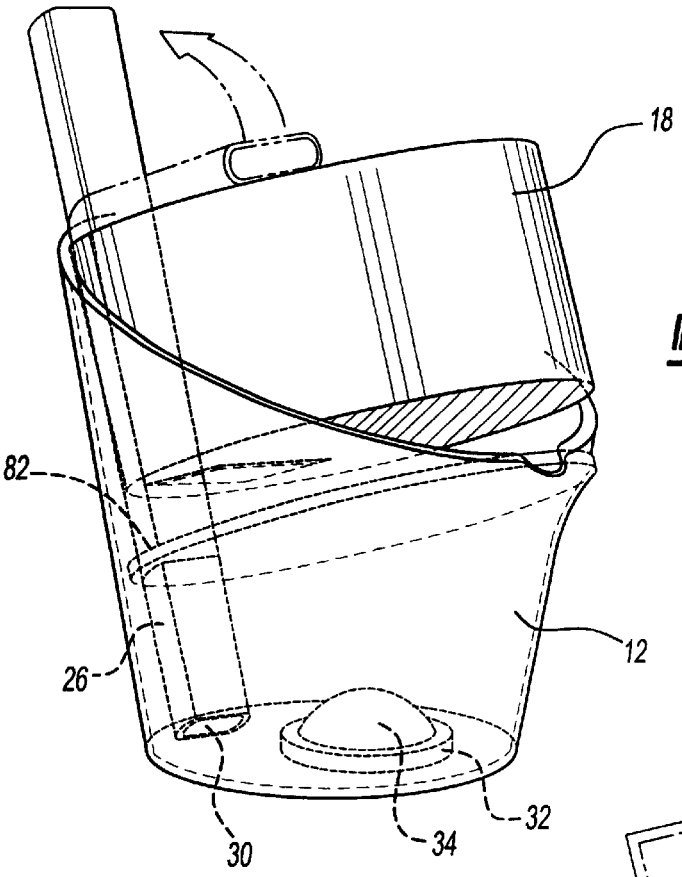
Figure 8B:
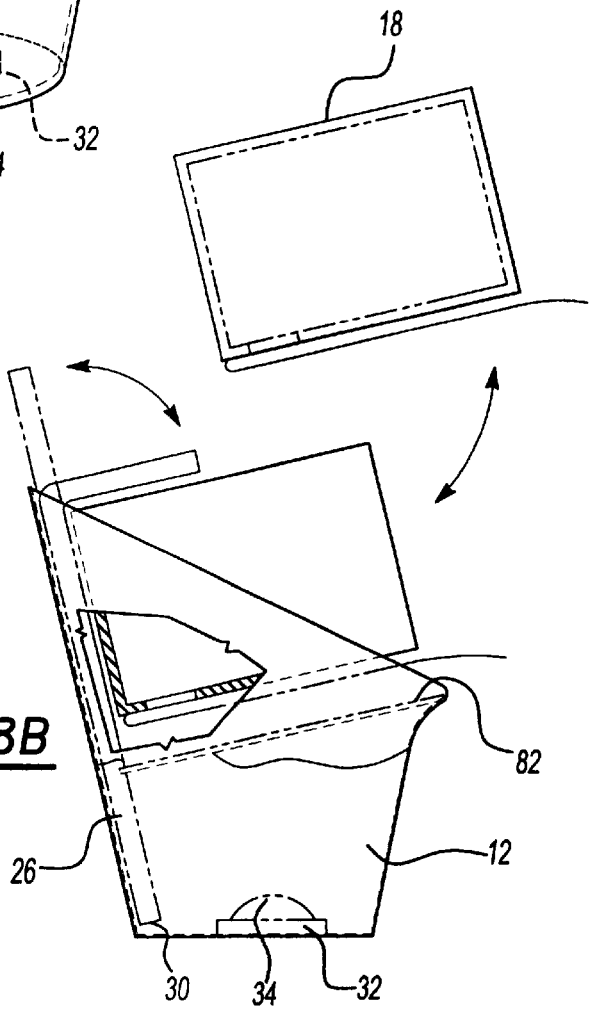

FIG. 8A shows a perspective view and FIG. 8*b* shows a side view of an eighth embodiment of the present invention. A first compartment (18) of the present invention is removable from the frame (82), while a second compartment (12) and a straw (26) are integral to the frame (82). The first compartment (18) slides into the frame (82) above the second compartment (12), leaving a gap in between the two compartments.

An opening at the bottom of the first compartment (18) is initially closed by a seal (19). After the first compartment (18) is placed into the frame (82), the seal (19) is pulled away and the opening at the bottom of the first compartment (18) is uncovered. Food stored in the first compartment (18) flows out of the opening and through the gap between the first compartment (18) and the second compartment (12).

The straw (26) is bendable at the top. When bent downward, the straw (26) constrains liquid flow.

Figure 9A:
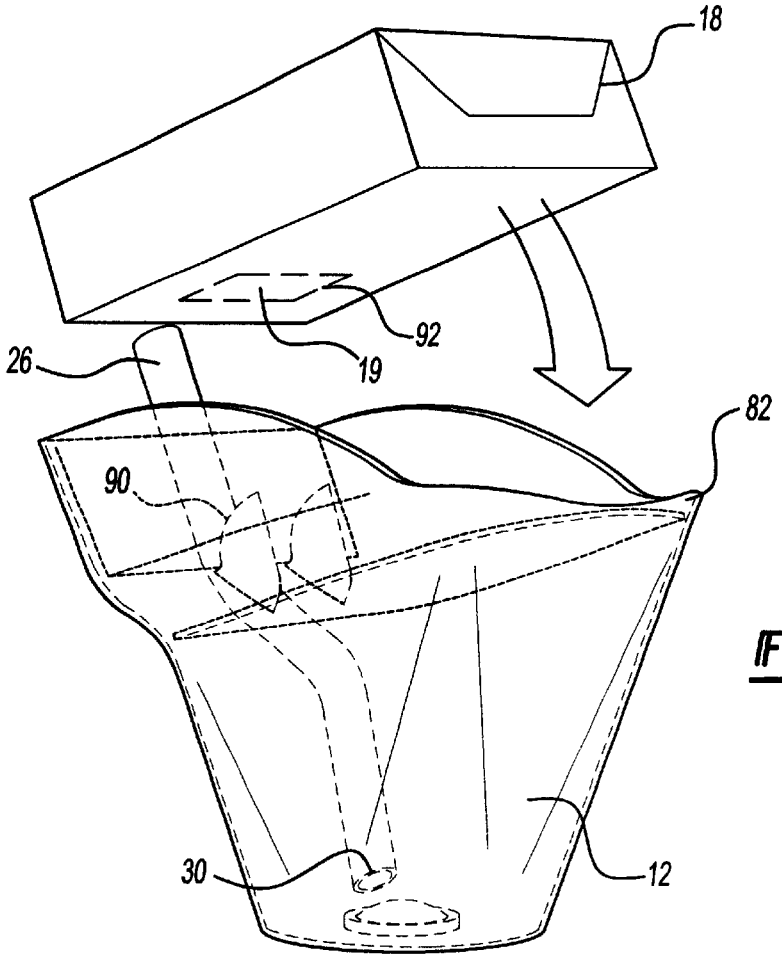
Figure 9B:
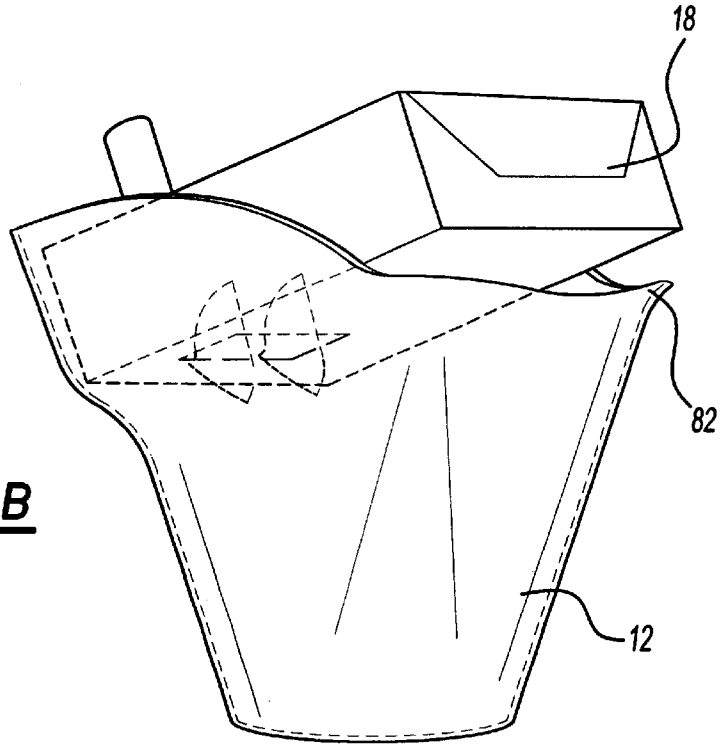

FIGS. 9A and 9B show a ninth embodiment of the present invention, where the first compartment (18) is a standard cereal box. The first compartment (18) has perforations (92) which are broken by knives (90) when the first compartment (18) is place into the frame (82). An opening (19) is formed when the perforations (92) are broken. Cereal pours out of the box (18) and through a gap between the cereal box (18) and the frame (82).

Liquid is withdrawn from the second compartment (12) through a straw (26).

Figure 10A:
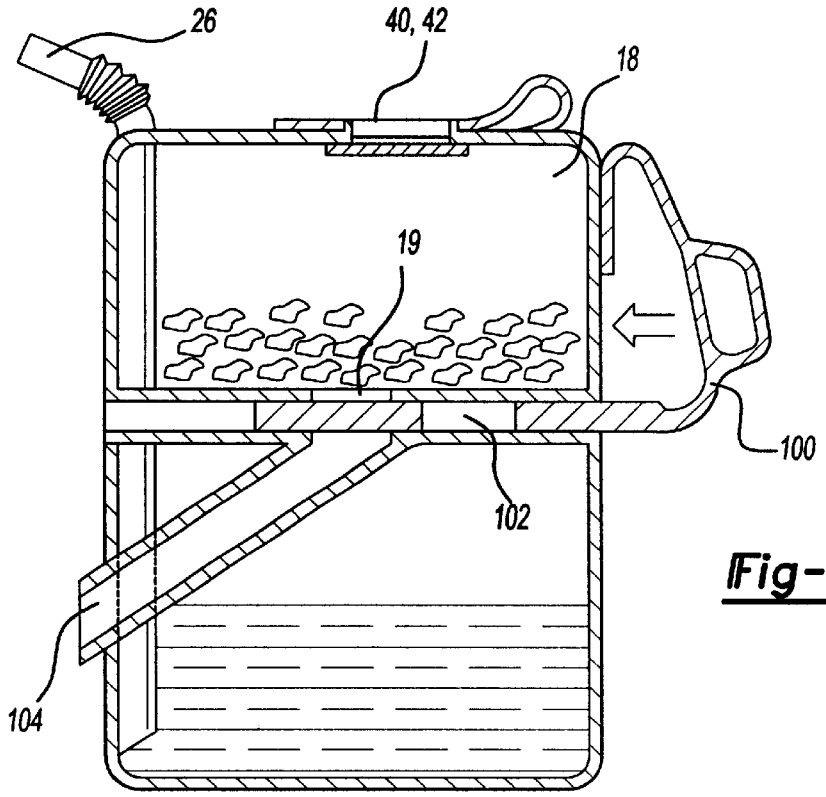
Figure 10B:
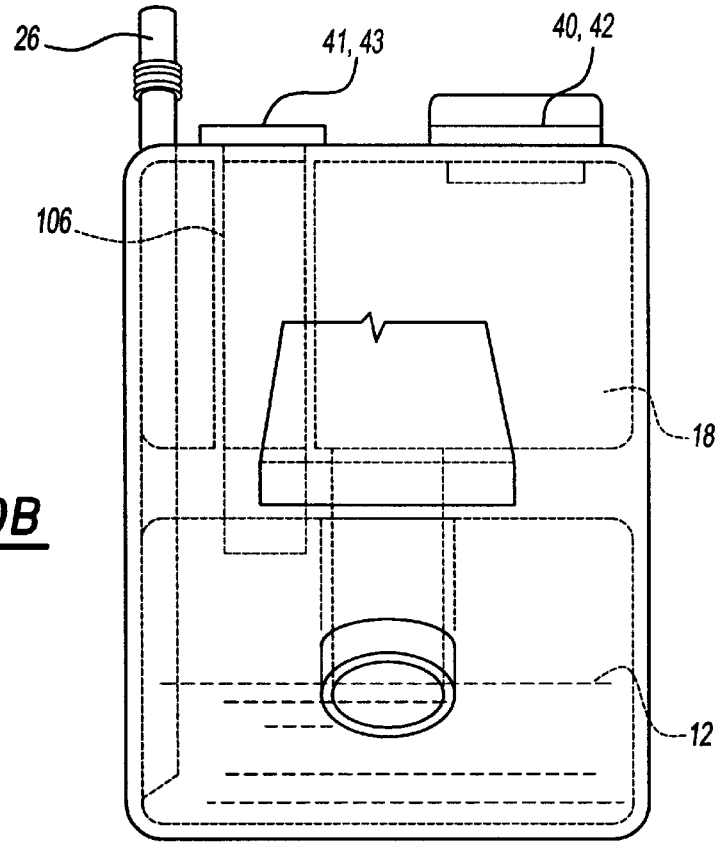
Figure 10C:
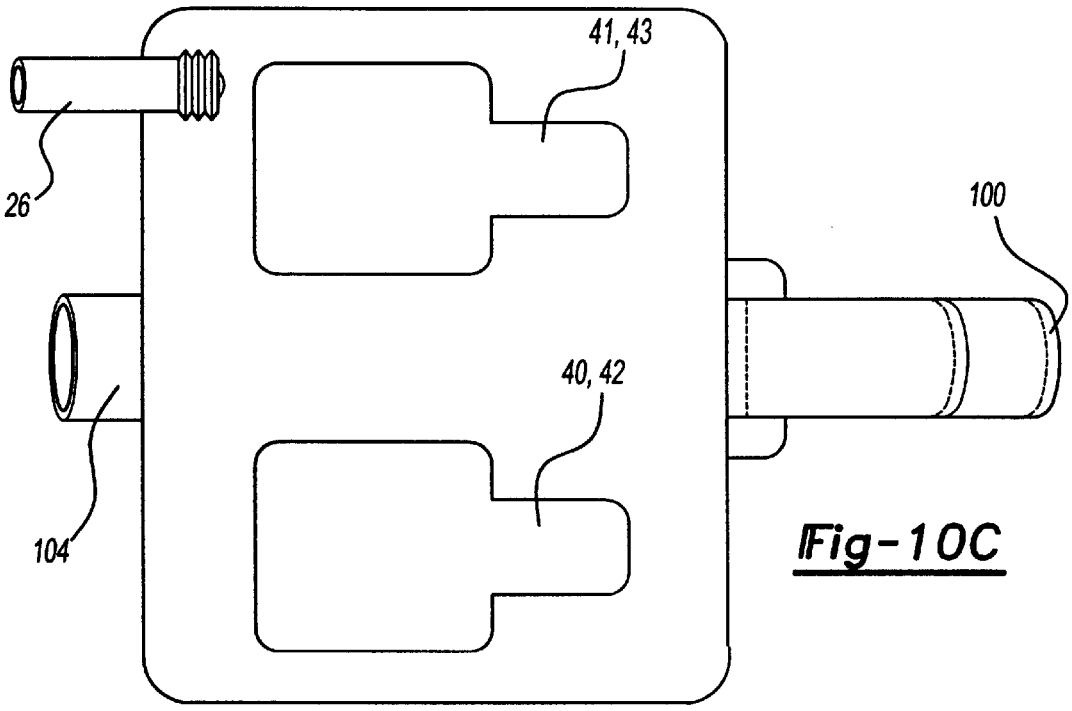

FIGS. 10A, 10B and 10C show three views of a tenth embodiment of the present invention. FIG. 10A is a sectional view which shows where the first compartment (18) is located above a second compartment (12). At the bottom of the first compartment (18) is an opening (19) leading to a sliding chamber (102) into which solid food from the first compartment (18) enters. The sliding chamber (102) is connected to a handle (100). When the handle (100) is compressed, the sliding chamber (102) slides into a position aligned with a chute (104). The solid food in the sliding chamber (102) pours out of the chute (104). A solid food port (40) allows solid food to be placed in the first compartment (18), and a cap (42) closes the port (40).

Liquid is withdrawn from the second compartment (12) through a straw (26). Liquid is placed in the second compartment (12) through liquid port (41), and the liquid port is closed by a cap (43). Looking at FIG. 10(*b*), the liquid port (41) is connected to the second compartment (12) through a duct (106).

Figure 11:
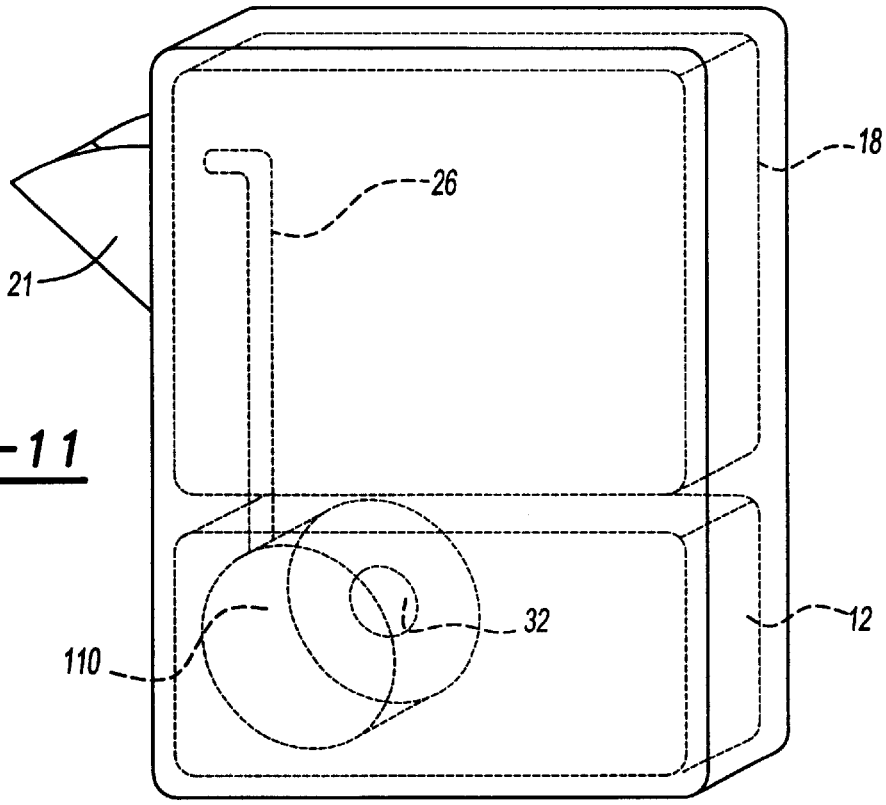

FIG. 11 shows an eleventh embodiment of the present invention, where a pump (110) is used in combination with a straw (26) to withdraw liquid from a second compartment (12). When the pump (110) is pressed, it forces air into the second compartment (12), the air forces liquid in the second compartment (12) up the straw (26). Liquid in the straw (26) pours out the top of the straw into a spout (21), where it mixes with solid food which pours from the first compartment (18).

Figure 12:
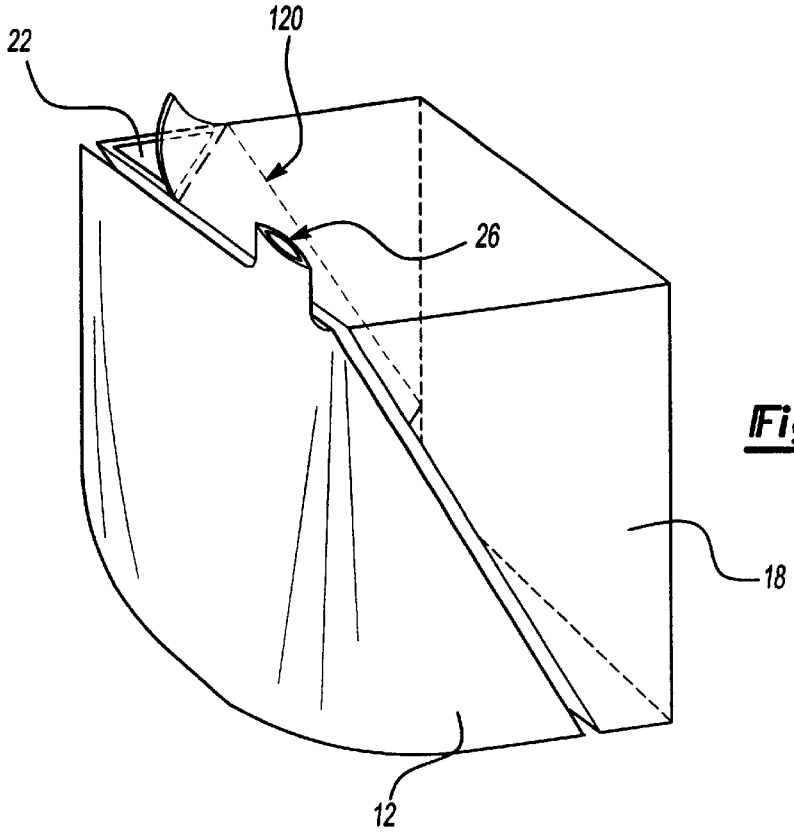

FIG. 12 shows yet another embodiment of the present invention. The second compartment is attached to the side of the first compartment (18). Liquid is withdrawn directly from the second compartment (12) through a straw-like opening (26). Solid food pours out of a first compartment (18) through an opening (22), but the amount of solid food pouring out is limited by a baffle (120).

Figure 13A:
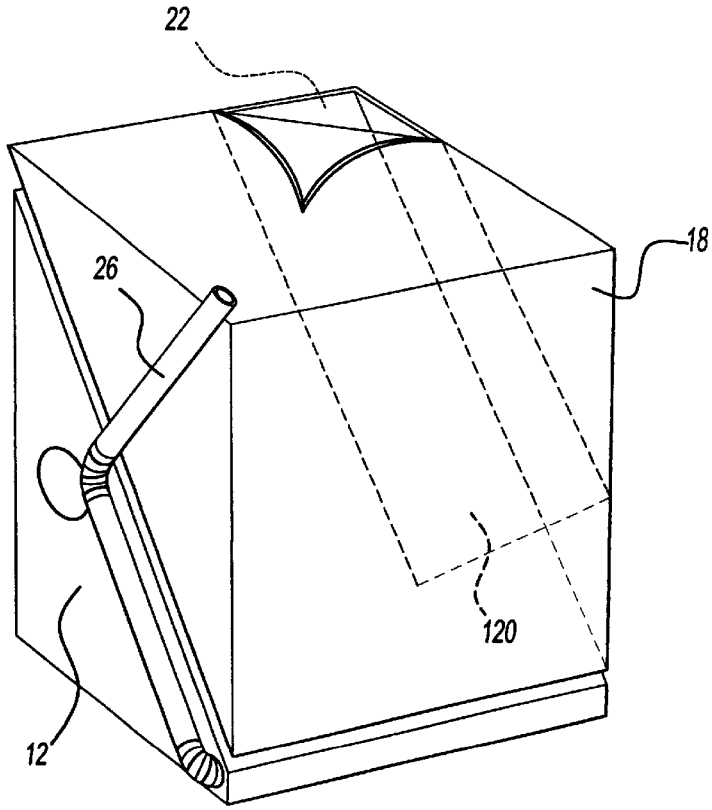
Figure 13B:
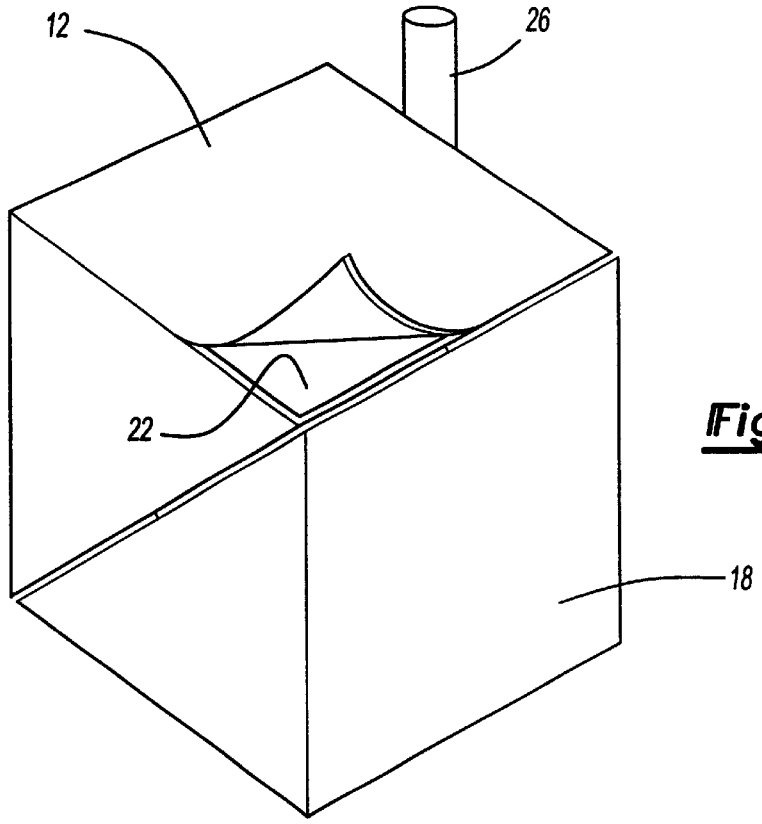
Figure 13C:
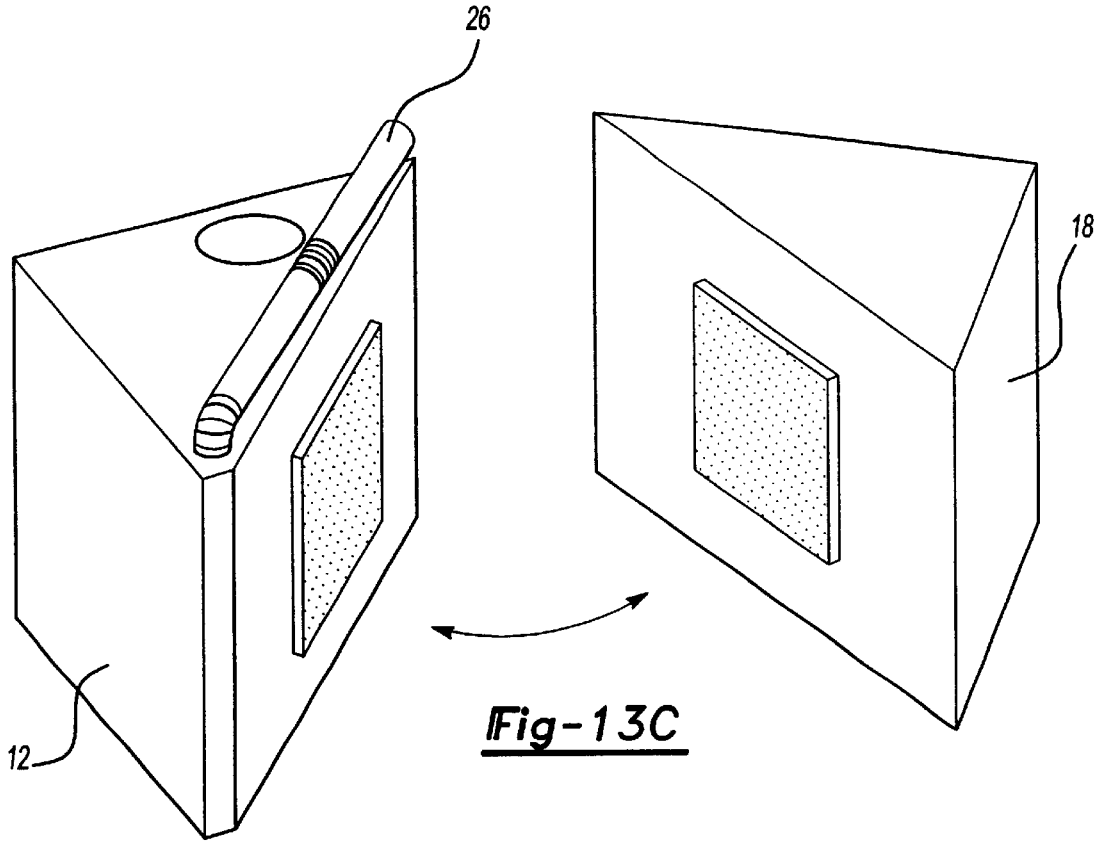

FIGS. 13(*a*), 13(*b*) and 13(*c*) show a thirteenth embodiment of the present invention. A first compartment (118) holding solid food has a triangular shape and an opening (22). A baffle (120) partially restricts the flow of solid food out of the opening (22).

A second compartment (12) is removably attached to the first compartment (118) by velcro or some other fastener. Liquid is withdrawn from the second compartment (12) by a straw (26).

What is claimed is:

1. A one-handed container for separately dispensing a dry particulate food and an edible liquid comprising:

a container having a first compartment separated by a partition from a second compartment, said second compartment adapted for receiving a liquid;

said first compartment adapted to receive a dry particulate food and having a discharge opening;

a straw having an inlet end and an outlet end, said inlet end in communication with said second compartment, one of said inlet end or said outlet end positioned across from said discharge opening, said straw preventing discharge of a liquid from said second compartment when said container is tilted toward said discharge opening.

2. A one-handed container as recited in claim 1, wherein said discharge opening further includes a resealable cover.

3. A one-handed container as recited in claim 2, wherein said resealable cover comprises a threaded lid, said discharge opening further including external threads adapted to receive said threaded lid.

4. A one-handed container as recited in claim 1, wherein said first compartment includes a baffle located adjacent said discharge opening.

5. A one-handed container as recited in claim 1, further including a second container received in said first compartment, said second container having a dry particulate food; and said first compartment including a pair of knives, said knives puncturing said second container when said second container is received in said first compartment, thereby discharging said dry particulate food into said first compartment.

6. A one-handed container as recited in claim 1, wherein said first compartment further includes a dry particulate food and said second compartment includes an edible liquid.

7. A one-handed container as recited in claim 1, wherein said second compartment further includes a flexible diaphragm.

8. A one-handed container as recited in claim 7, wherein said flexible diaphragm comprises a removable flexible diaphragm.

9. A one-handed container as recited in claim 8, wherein said removable flexible diaphragm comprises a snap-in flexible diaphragm.

10. A one-handed container as recited in claim 1, further including a releasable connection between said first compartment and said second compartment.

11. A one-handed container as recited in claim 10, wherein said releasable connector comprises a hook and loop connector.

* * * * *